US005660638A

United States Patent [19]

Amano et al.

[11] Patent Number: 5,660,638

[45] Date of Patent: Aug. 26, 1997

[54] JIG FOR PRODUCING ELECTRONIC COMPONENTS WITH SIDE ELECTRODES

[75] Inventors: Koshi Amano; Satoru Yatake, both of Fujiyoshida, Japan

[73] Assignee: Rohm Co., Ltd., Kyoto, Japan

[21] Appl. No.: 525,291

[22] Filed: Sep. 7, 1995

[30] Foreign Application Priority Data

Sep. 13, 1994 [JP] Japan ..... 6-218676

[51] Int. Cl.[6] ..... B05C 13/02

[52] U.S. Cl. ..... 118/503; 118/500; 269/43; 269/903

[58] Field of Search ..... 118/500, 503; 427/282, 290; 269/43, 254 R, 903

[56] References Cited

U.S. PATENT DOCUMENTS 4,788,931 12/1988 Nitta et al. ..... 118/503

FOREIGN PATENT DOCUMENTS 62-11488 3/1987 Japan .
62-20685 5/1987 Japan .

*Primary Examiner*—Donald E. Czaja
*Assistant Examiner*—Steven B. Leavitt
*Attorney, Agent, or Firm*—Fay, Sharpe, Beall, Fagan, Minnich & McKee

[57] ABSTRACT

A jig in a plate form capable of efficient formation of side electrodes on electronic components in a plate form. After electrode formation on one side of each electronic component, an electrode can be formed on the other side without causing spalling or chipping of the already formed side electrode. The jig 1 includes a core member 3 having a soft member 4 joined thereto and has a multiple of grooves 5 and 6 formed on reverse sides, respectively, in such a way that aligned electronic components A can be pushed into the grooves. The inner sides of each groove are composed of the soft member 4. Side electrodes B are formed on both sides of an electronic component as it is held between the opposed inner sides of grooves 5 or 6. The grooves 6 on the reverse side of the jig 1 into which the first formed side electrodes B are to be fitted may be sized to be wider than the grooves 5 on the reverse side so that electronic components A can be pushed into and pulled out of the grooves 6 without causing spalling and chipping of the already formed side electrodes B.

9 Claims, 6 Drawing Sheets

JIG FOR PRODUCING ELECTRONIC COMPONENTS WITH SIDE ELECTRODES

BACKGROUND OF THE INVENTION

This invention relates to a jig for producing rectangular electronic components with side electrodes as exemplified by laminated ceramic capacitors and network resistors. More particularly, the invention relates to a jig for assisting in the application of a conductive paint onto end faces of electronic components in a rectangular plate form, thereby forming side electrodes.

Certain types of electronic components such as laminated ceramic capacitors have side electrodes. To form such side electrodes, a jig generally indicated by 20 in FIGS. 13*a*, 13*b*, 14*a* and 14*b* is conventionally employed in a manner typically described in Japanese Patent Publication (kokoku) Nos. 11488/1987 and 20685/1987. As shown, jig 20 comprises a rectangular frame 21 defining its periphery, an elastic sheet 22 fitted in the frame 21, and a core sheet 23 that is embedded in the elastic sheet 22 and secured to the frame 21. A multiple of holes 24 slightly smaller in diameter than the circumscribed circle about an electronic component A are made in the core sheet 23 and the elastic sheet 22.

As shown in FIG. 14*a*, the electronic component A is pressed part of the way into a corresponding hole 24 in counteraction against the resiliency of the elastic sheet 22, whereupon the electronic component A is held in such a state that one lateral side A1 is exposed on the surface of the jig 20. Then, the jig 20 is fixed to a base 26 by means of screws (not shown) that are inserted through holes 25 in the two shorter sides of the frame 21. When the base 26 is moved under a roller as it is supplied with a conductive paste (ink) on its circumference, the paste is applied onto one lateral side A1 of each electronic component A. Thereafter, the base 26 with the jig 20 mounted thereon is passed through a drying zone so that the applied conductive paste is heated to dry, whereby a side electrode B is formed on one lateral side A1 of the electronic component A.

In the next step, the jig 20 is dismounted from the base 26 and the electronic compound A having side electrode B formed on one lateral side A1 is pushed part of the way to the back surface of the jig 20 until the other lateral side A2 of the electronic component A is exposed on said back surface of the jig 20 (see FIG. 14*a*). The jig 20 is then remounted on the base 26 and the above-described procedure is repeated to form a side electrode B on the other lateral side A2 of each electronic component A.

This prior art technique has the advantage of achieving improved productivity since side electrodes B can be formed on a multiple of electronic components A in a single step. On the other hand, the following problems are involved in this technique.

(1) The holes 24 in the jig 20 must be preset to have a size that is determined by the cross-sectional shape of each electronic component A and, hence, more than one kind of jig 20 must be provided in accordance with the type of the electronic components A to be processed and this not only increases the production cost of jigs 20 but also requires a substantial burden on the operating personnel in the management of more than one kind of jig.

(2) The jig 20 is produced by a so-called "insert shaping" method, in which core sheets 23 are held between a pair of molds and the cavities formed in the mating surfaces of the two molds are filled with a molten soft material; however, the need to form a number of holes 24 calls for the use of molds having a complex structural design and this also adds to the production cost of jigs 20.

(3) In the absence of any means for supporting the electronic components A that have been pushed part of the way into the corresponding holes 24, the distance by which the lateral sides A1 and A2 of electronic component A project beyond the jig 20 will vary from one component to another and this can potentially cause inconsistency in the thickness of side electrodes B formed on those lateral sides.

(4) If the electronic component A is in a plate form, it cannot be retained in a stable position within a corresponding hole 24 and, hence, the prior art technique cannot successfully be applied to the manufacture of electronic components in a plate form such as thin chip capacitors, network capacitors and network resistors.

(5) The side electrodes B are formed on opposite surfaces of each electronic component A in such a way that they protrude laterally; therefore, when electronic component A that has a side electrode B formed on one lateral side A1 is pushed into a hole 24 toward the back surface of the jig 20, the formed side electrode B will be strongly rubbed against the inner surfaces of the hole 24, whereupon spalling and chipping of the side electrode B may occur to yield defective products.

SUMMARY OF THE INVENTION

An object, therefore, of the present invention is to provide a novel jig for producing electronic components with side electrodes which is free from the aforementioned problems of the prior art technique.

This object of the invention can be attained by a jig for producing electronic components with side electrodes, which jig being in a generally plate form comprising a highly rigid core member and a soft member which is joined to said core member, said jig being capable of holding a multiple of electronic components in a straight line on at least one surface, said jig having a plurality of grooves that are each composed of the soft member on the inner sides and of the core member on the bottom surface and which extend along the length of said jig, the depth of said grooves being smaller than the distance between the sides of each electronic component on which electrodes are to be formed.

In a preferred embodiment of the invention, a plurality of grooves are formed in both surfaces of said jig along its length such that the grooves formed in one surface of said jig are wider than those in the other surface by a size equivalent to the one by which a side electrode projects beyond opposite ends of the electronic component on which said side electrode is formed.

According to the invention, side electrodes are formed on electronic components which are fixed to the jig as they are arranged in a straight line and, hence, the number of electronic components that can be retained per unit area of the jig is sufficiently increased to improve the production efficiency of the electronic components.

Holding the electronic components in a row on the jig offers the added advantage that side electrodes can be formed on the electronic components as they are retained in a stable manner even if they are in a plate form and, hence, the efficiency of producing electronic components in a plate form such as network capacitors and resistors can be improved.

Another feature of the invention is that a multiple of electronic components in a row are pushed into the multiple of grooves extending along the length of the jig so that the electronic components are held in position by the resiliency of the soft member which is one of the two components of the jig, whereby the multiple of electronic components can be secured with either one of the sides of each electronic component being exposed on a surface of the jig.

Since the jig of the invention fixes the electronic components by means of the resiliency of the soft member which is one of its two components, the jig is capable of forming side electrodes on a multiple of electronic components with high efficiency despite its simple structure.

Yet another feature of the invention is that electronic components of the same thickness can be fixed on one unit of jig even if they differ in width. In other words, a single kind of jig can be used to apply side electrodes on more than one kind of electronic components and this contributes to a substantial reduction in the manufacturing cost of the jig and the care involved in the management of jigs.

As a further advantage, forming simple grooves suffices for the invention, so even if the soft member is to be joined to the core member by the conventional insert shaping method using a pair of molds, the molds can have a sufficiently simplified design to realize a further reduction in the manufacturing cost of the jig.

Forming grooves in both surfaces of the jig along its length offers the following advantage: electronic components are first fixed in the grooves in one surface of the jig and a side electrode is formed on one side of each electronic component; then, the electronic components are removed from the jig and replaced in the grooves in the other surface of the jig, whereby side electrodes can be formed on opposed sides of all electronic components using a single unit of the jig.

If the grooves in the other surface of the jig are formed to have a greater width than those in the one surface, the electronic components that have side electrodes formed on one side can be pushed into the grooves in the other surface and removed therefrom after the formation of side electrodes while ensuring that the projecting portions of the side electrodes from both ends of one side of each electronic component will not be excessively rubbed against the inner surfaces of the grooves and this is effective in preventing the spalling and chipping of the side electrodes, thereby improving the yield of the production of electronic components with side electrodes.

BRIEF DESCRIPTION OF THE DRAWINGS

FIG. 13*a* is a partial enlarged view, with part taken away, of FIG. 13*a;*

FIG. 14*a* is a partial sectional view showing how an electrode B is formed on the other lateral side of electronic component after the formation of electrode B on one lateral side as shown in FIG. 14*a*.

DESCRIPTION OF THE PREFERRED EMBODIMENTS

Figure 1A:
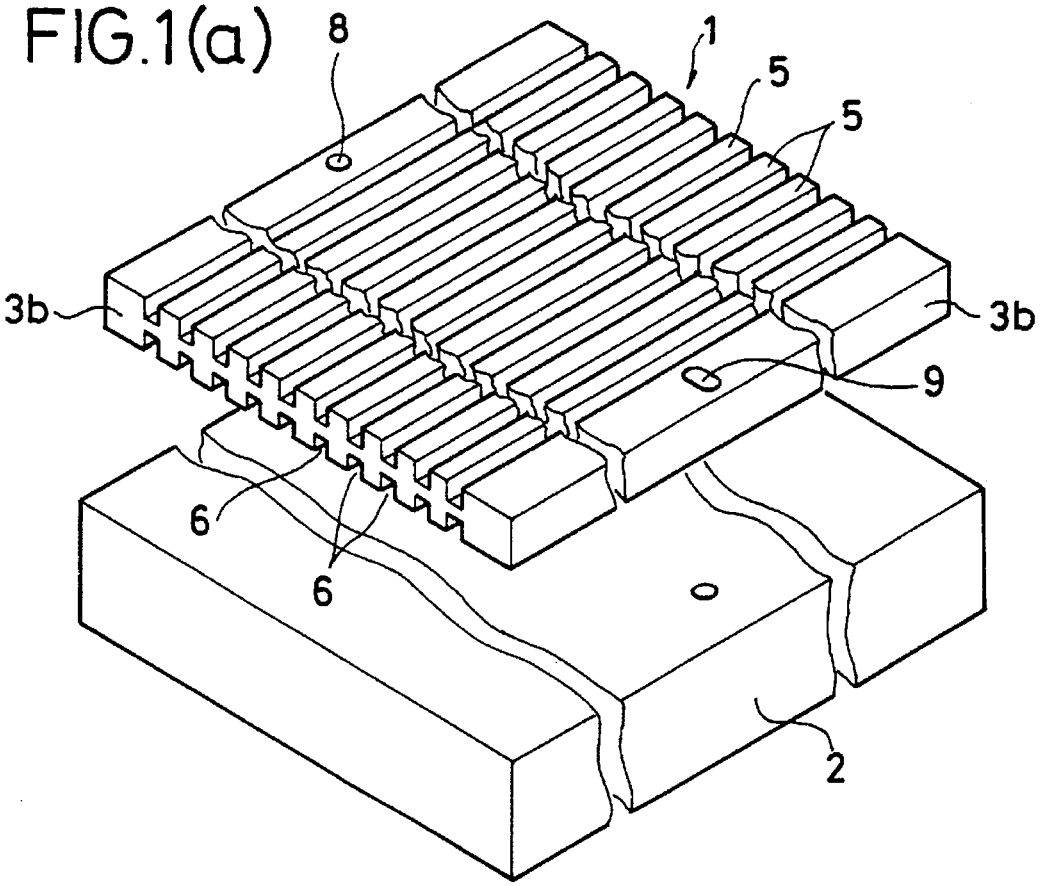
FIG. 1*a* is a perspective view of an entire jig according to a first embodiment of the invention.

The jig of the present invention will now be described in greater detail with reference to the accompanying FIGS. 1–12, among which the first ten drawings show the first embodiment of the invention. In the drawings, numeral 1 refers to the jig of the invention and 2 refers to the base on which the jig is to be mounted. The jig 1 comprises a highly rigid core member 3 to which a soft member 4 typically formed of rubber is joined to make up a generally rectangular plate body (see FIG. 10). A plurality of grooves 5 and 6 extending along the length of the jig 1 are formed in selected areas of the soft member 4 on opposite side thereof in such a way that they are open to the shorter sides of the jig 1.

The core member 3 may be formed of a metal such as aluminum or stainless steel or a heat-resistant hard synthetic resin. The soft member 4 may be formed of a rubber such as a fluororubber, a silicone rubber or a urethane rubber. If desired, the soft member 4 may be of such a type that it incorporates a conductivity imparting agent.

Figure 1B:
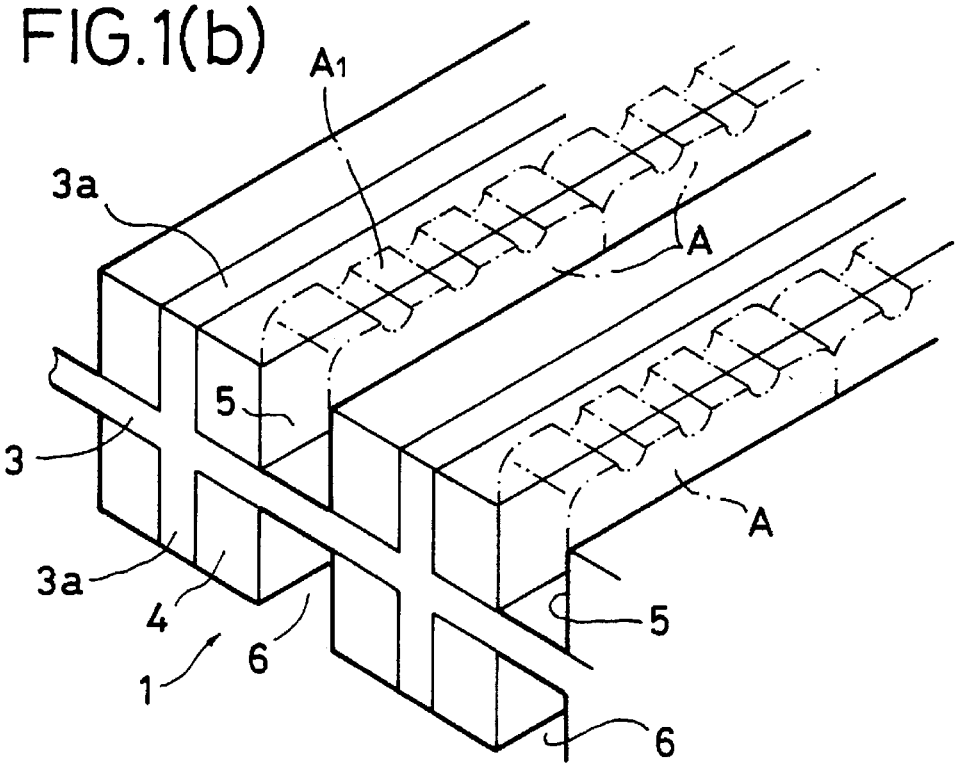
FIG. 1*b* is a partial enlarged perspective view of the jig.

As shown in FIG. 1*b*, that portion of core member 3 which is located between adjacent grooves 5 or 6 forms a rib 3*a* extending along the length of the jig 1 in such a way that it is exposed an both surfaces of the jig.

Figure 2:
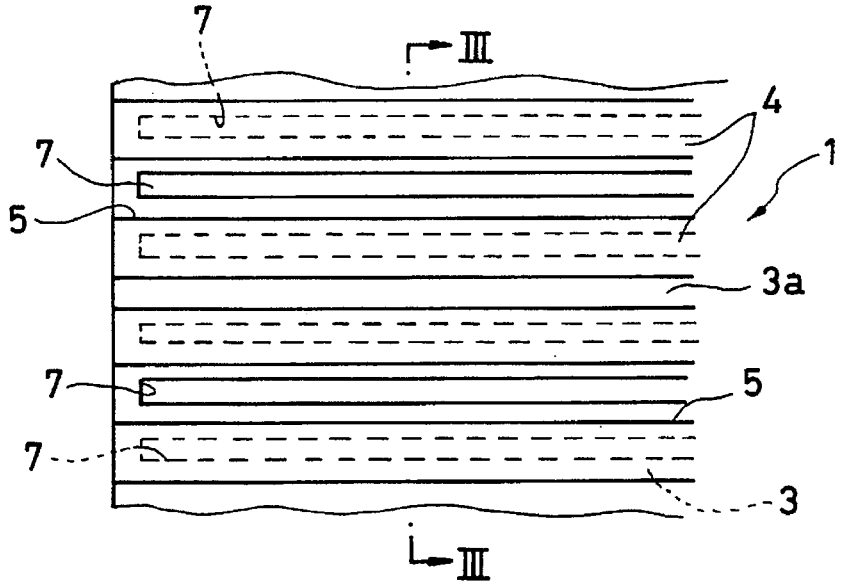
FIG. 2 is a partial plan view of the jig shown in FIG. 1.

As shown in FIG. 2, an elongated hole 7 extending along the length of the jig 1 is formed in the core member 3 in an area corresponding to the bottom of each groove 5 or 6 located between adjacent grooves 5 of 6.

Figure 3:
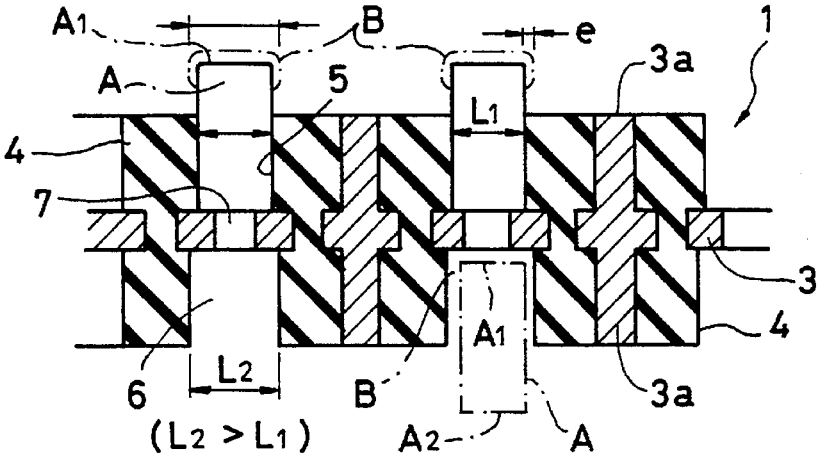
FIG. 3 is a partial section taken on line III—III of FIG. 2.

Referring to FIG.3, the grooves 5 and 6 have respective widths L1 and L2 of such values that electronic component A can be pushed into those grooves in counteraction against the resiliency of the soft member 4. The depths of the grooves 5 and 6 are of such values that side A1 or A2 of electronic component A will become exposed on the jig when it has been pushed into the grooves.

In the embodiment under discussion, L2, or the width of each of the grooves 6 formed on the reverse side of the jig 1 is set to be greater than L1, or the width of each of the grooves 5 on the reverse side of the jig, by a value comparable to the total distance by which side electrode B projects beyond both ends of electronic component A. Stated more specifically with reference to the case where the jig 1 is intended for use in the manufacture of laminated ceramic capacitors of a network type, L2 has been found to be advantageous if it is set at a value greater than L1 by about 0.03–0.1 mm.

Figure 10:
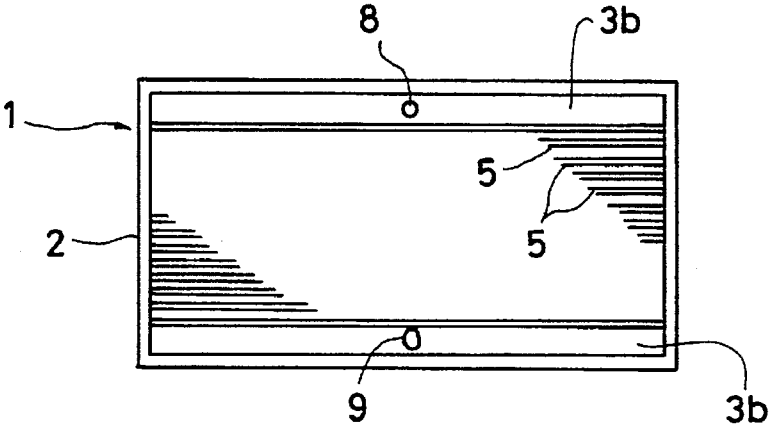
FIG. 10 is a plan view of the jig as it has been mounted on a base.

As shown in FIGS. 1*a* and 10, through-holes 8 and 9 are formed in the middle of the longer side edges 3*b* of the core member 3 so that the jig 1 can be fixed to the base 2 by means of screws. In the embodiment under consideration, through-hole 9 is a prolate hole that extends in a direction normal to the longer side edge in which it is formed and this provides for adjustment in the posture of the jig 1 being mounted on the base 2.

Having the structural design described above, the jig 1 of the first embodiment of the invention may be employed as follows to form side electrode B on both sides A1 and A2 of electronic component A. First, semi-finished products of electronic components that have inner electrode A3 exposed on both sides A1 and A2 (see FIG. 8*a*) are pushed into each of the grooves 5 in one surface of the jig 1 in such a way that side A1 of each electronic component A will face up as shown in FIG. 1*b* or 4.

Figure 4:
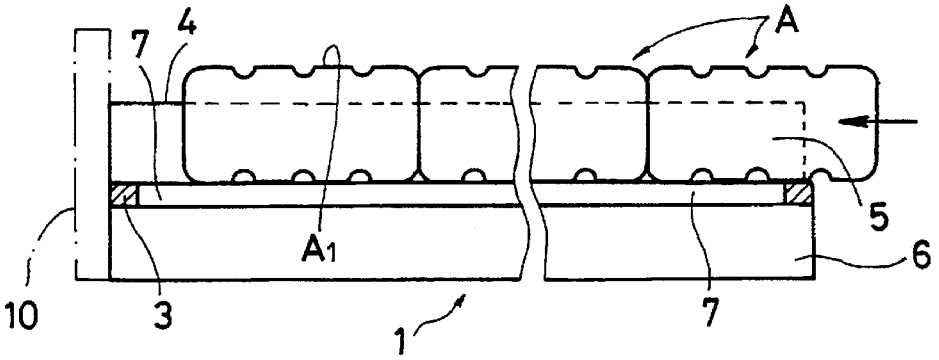
FIG. 4 is a partial sectional view showing a line of electronic components mounted on the jig.

In this case, the electronic components A may be pushed into the grooves 5 with a stopper member 10 being held in contact with one end face of the jig as indicated by a one-long-and-one-short dashed line in FIG. 4 and this is effective in bringing the inserted rows of electronic components A into registry with one another in an end portion. If desired, the jig 1 may be deflected to deform in an upward convex shape along the length of the jig 1 as shown exaggerated in FIG. 5 and, consequently, the grooves 5 on the jig 1 will become wider in the top than in the bottom by a sufficient degree to facilitate the insertion of electronic components A.

Figure 6:
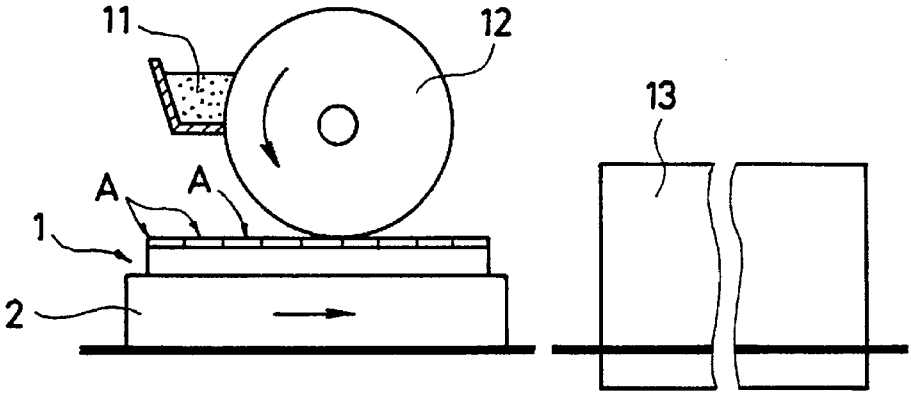
FIG. 6 is a schematic diagram showing the steps of forming side electrodes.

In the next step, the jig 1 is fixed to the base 2 by means of screws and the assembly is transported below and in contact with a roller 12 as it is supplied with a conductive paste 11 (see FIG. 6). As a result, the conductive paste is applied to one side A1 of each electronic component A. Thereafter, the jig 1 as well as the base 2 is transferred into a drying zone 13, in which it is heated to dry the conductive paste, thereby forming side electrode B on one side A1 of each electronic component A.

Figure 8A:
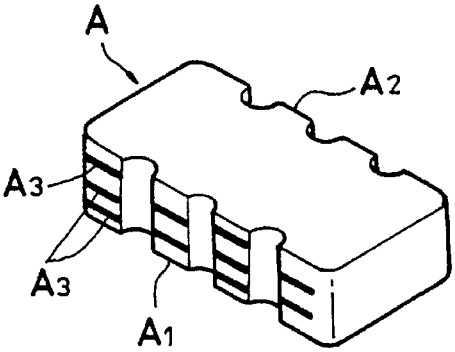
FIG. 8*a* is perspective view of an electronic component without side electrodes.
Figure 8B:
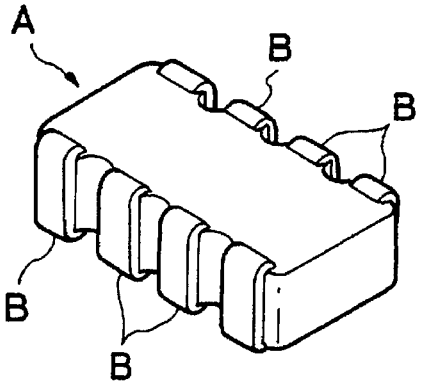
FIG. 8*b* is a perspective view of a completed electronic component with side electrodes.
Figure 9A:
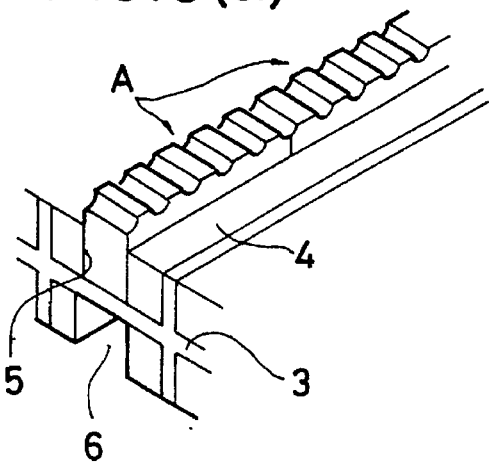
FIG. 9*a* is a perspective view of network electronic components as they have been fitted into a groove.
Figure 9B:
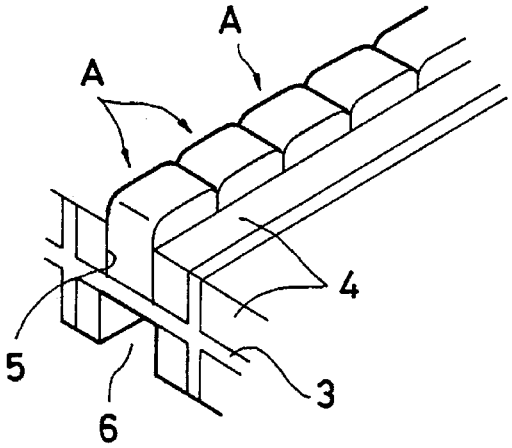
FIG. 9*b* is a perspective view of chip electronic components as they have been fitted into a groove.

Then, the jig 1 is separated from the base 2 and the electronic components A are removed from the jig 1 and replaced in the grooves 6 on the reverse side of the jig 1, which is subsequently remounted on the base 2. The same procedure as described above is followed to form side electrode B on the other side A2 of each electronic component A. Thus, complete products of electronic component A are obtained with side electrodes B being formed as shown in FIG. 8*b*.

Alternatively, a second jig having broader grooves than the first jig 1 is placed on top of the first jig as it holds the electronic components A having side electrodes B formed on one side, whereby those electronic components B can be transferred into the grooves in the second jig in one action. When the transfer of the electronic components is complete, the same procedure as described above is followed to form side electrode B on the other side A2 of each electronic component. This method allows side electrodes to be formed on both sides of each electronic component in a more efficient way.

Figure 7:
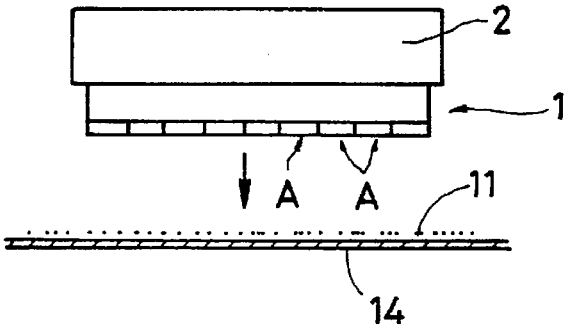
FIG. 7 is a schematic diagram showing another means of forming side electrodes.

FIG. 7 shows another way to have the conductive paste coated on both sides A1 and A2 of each electronic component; as shown, the base 2 to which the jig 1 is fixed is turned upside down after side electrode B has been formed on one side A1 and the thus reversed base 2 is lowered toward a layer 14 of the conductive paste 11.

It should be added that the constituent material of the side electrode B is by no means limited to the conductive paste 11 but may be replaced by any particulate materials that solidify upon heating. Such electrode forming materials are well known to the skilled artisan.

As described on the foregoing pages, the jig of the present invention allows side electrodes B to be formed on both sides of a multiple of electronic components A that are aligned in both grooves 5 and 6 in the jig and by so doing, the number of electronic components A that can be mounted per unit area of the jig 1 is sufficiently increased to improve the production efficiency of the electronic components.

Another advantage of the invention is that electronic components A having different lengths can be mounted on a single unit of jig 1 as long as they have the same width and there is no need to provide as many units of jig 1 as electronic components A of different kinds. This means a substantial reduction in the manufacturing cost of the jigs 1 and the amount of care involved in their management.

It should also be noted that the jig of the invention which holds electronic components between opposed inner sides of each of the grooves 5 and 6 is particularly suitable for use in the fabrication of plate-like electronic components A such as laminated network capacitors and network resistors.

If the grooves 6 in the reverse surface of the jig 1 are formed to be wider than the grooves 5 in the reverse surface as in the first preferred embodiment described above, the electronic components A each having the side electrode B formed on one side A1 can be replaced in the grooves 6 without letting the already formed side electrodes B to be excessively rubbed against the inner sides of those grooves; hence, there will be no chance of the spalling or chipping of the side electrodes B once they have been formed on one side A1 of the electronic components A.

In the first embodiment, the core member 3 has the rib 3*a* formed in areas between adjacent grooves 5 or 6 in order to enhance the stiffness of the jig 1 and this is effective in preventing the occurrence of warpage in the jig which would otherwise introduce unevenness in the thickness of the side electrodes B formed on either side of the electronic components.

If a conductivity imparting agent is incorporated in the soft member 4 as in the first embodiment, static buildup on the jig 1 can be prevented, thereby ensuring against the deposition of the conductive paste and dust particles on the jig 1 due to static electricity that develops during the application of the conductive paste.

Figure 5:
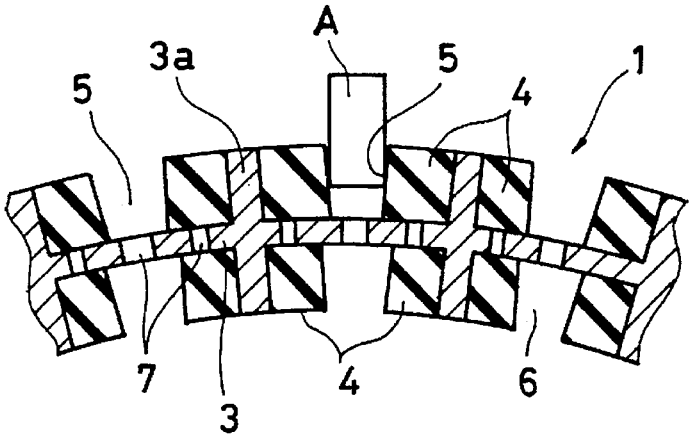
FIG. 5 is a schematic sectional view showing how a line of electronic components are mounted on the jig.

In the first embodiment, elongated hole 7 is formed in the bottom of each of the grooves 5 and 6 and this has the advantage of not only preventing dust buildup in those grooves but also allowing the jig 1 to deform easily by deflecting as shown in FIG. 5.

Turning back to the prior art technique shown in FIGS. 13*a*, 13*b*, 14*a* and 14*b*, the jig is formed as a rectangular member and the shorter sides of it are fixed to the base by means of screws but this has caused the problem of warpage which occurs in the jig if it undergoes thermal expansion during the subsequent drying step. In the first embodiment of the invention, however, mounting holes 8 and 9 are formed in the longer side edges 3*b* of the jig 1 to assist in its fixing to the base 2 and this ensures against the occurrence of warpage in the jig 1 even if it experiences thermal expansion during the subsequent drying step. In the absence of thermal warpage, there will be no possibility for side electrodes B to be formed in uneven thicknesses. It should particularly be noted that the mounting hole 9 which assumes a prolate circular shape is effective in absorbing any warpage that occurs in the jig due to thermal expansion.

If the opposed inner surfaces of the grooves 5 and 6 wear, the soft material 4 may be processed by a milling machine so that it is shaven or peeled by the necessary thickness to permit rebonding of the soft member 4. This step of reclamation adds to the overall economy of the process of jig production.

Figure 11:
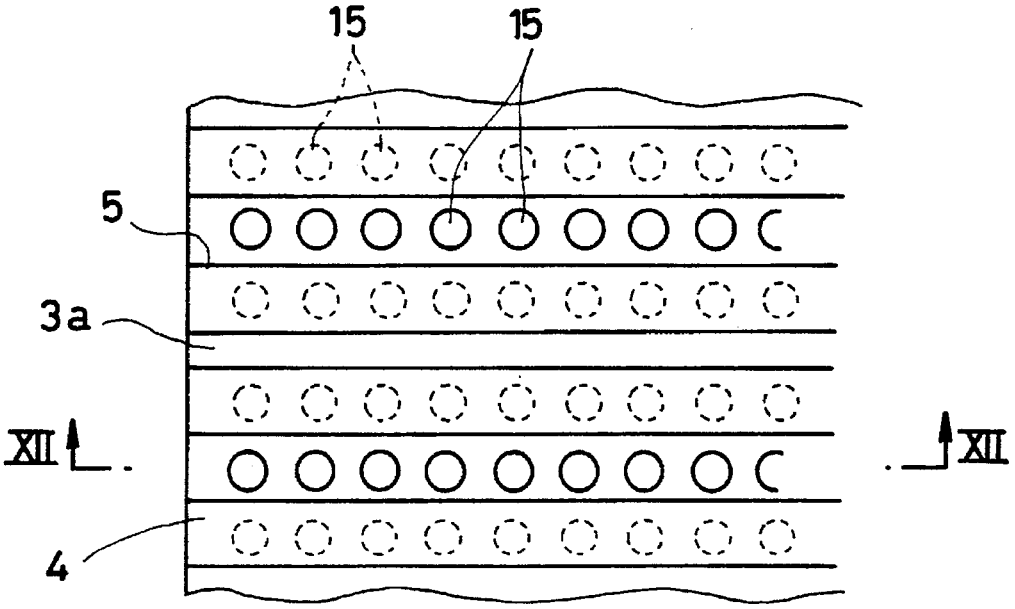
FIG. 11 is a partial plan view of a jig according to a second embodiment of the invention.
Figure 12:
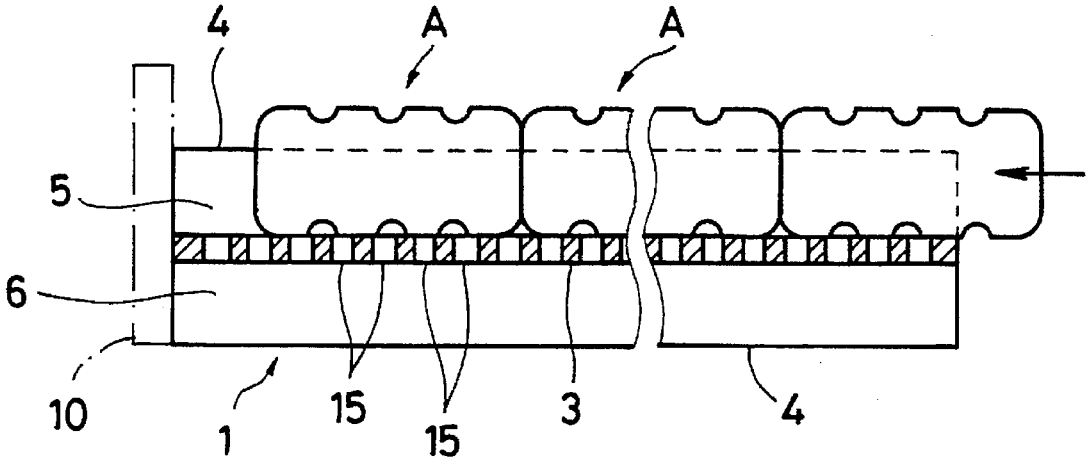
FIG. 12 is a partial section taken on line XII—XII of FIG. 11.
Figure 13A:
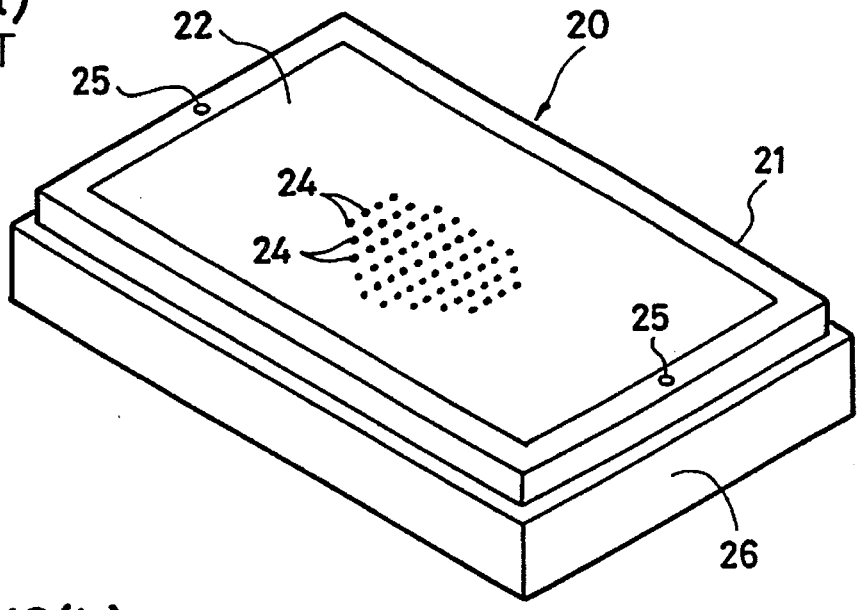
FIG.13(a) PRIOR ART
FIG. 13*a* is a perspective view of an entire part of a prior art jig.
Figure 13B:
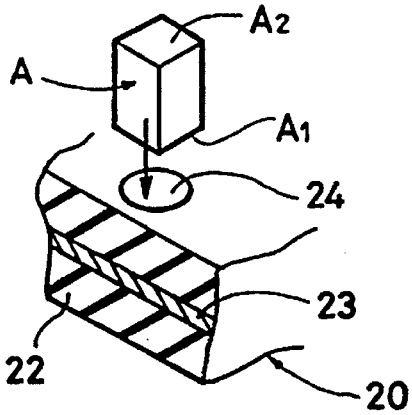
FIG.13(b) PRIOR ART
Figure 14A:
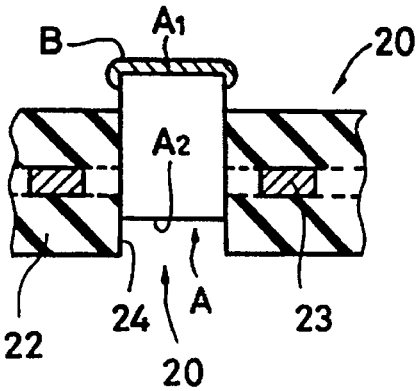
FIG.14(a) PRIOR ART
FIG. 14*a* is a partial sectional view showing how an electrode B has been formed on one lateral side of electronic component A using the prior art jig shown in FIG. 13.
Figure 14B:
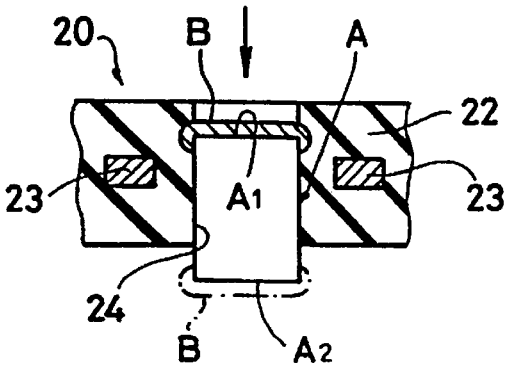
FIG.14(b) PRIOR ART

FIGS. 11 and 12 show a jig according to the second preferred embodiment of the invention, in which the elongated hole 7 formed in the first embodiment is replaced by a plurality of round holes 15 that are spaced apart in selected areas of the core member 3 corresponding to the bottom of each groove 5 or 6 located between adjacent grooves 5 or 6.

We claim:

1. A jig for producing electronic components with side electrodes by applying a conductive paint to faces on opposite sides of said electronic components, said jig being generally in a plate form and comprising a highly rigid core member and a soft member which is joined to said core member, a plurality of grooves each composed of said soft member on the inner sides thereof and of the core member on the bottom surface thereof and which extend along the length of said jig on both surfaces thereof, the depth of said grooves being smaller than the distance between the faces of each electronic component on which electrodes are to be formed and wherein the grooves formed in one surface of said jig are wider than those in the other surface by a distance equivalent to the total distance by which a side electrode projects beyond opposite edges of the electronic component on which said side electrode is formed.

2. A jig according to claim 1, wherein said core member is formed of a metal or a heat-resistant hard synthetic resin and said soft member is formed of a rubber.

3. A jig according to claim 2, wherein said metal is aluminum or stainless steel and said rubber is a fluororubber, a silicone rubber or a urethane-base rubber.

4. A jig according to claim 2, wherein said rubber incorporates a conductivity imparting agent.

5. A jig according to claim 1, wherein said core member has ribs that are high enough to reach the top surface of the soft member and which are embedded in said soft member.

6. A jig according to claim 5, wherein said hole is a single prolate hole extending along the length of each of said grooves.

7. A jig according to claim 1, wherein each of said grooves has a bottom with a hole penetrating therethrough.

8. A jig according to claim 1, wherein each of said grooves has a bottom with a plurality of holes therethrough.

9. A jig according to claim 1, which has at least two mounting holes in the longer side edges thereof for fixing said jig to a base, at least one of said mounting holes having a prolate circular shape.

* * * * *